US011655624B2

(12) United States Patent
Catanese et al.

(10) Patent No.: US 11,655,624 B2
(45) Date of Patent: May 23, 2023

(54) TEMPERATURE-CONTROLLED URINAL MODULE TO PREVENT ODORS

(71) Applicants: Federico Catanese, Mendoza (AR); Esteban Rovello, Mendoza (AR)

(72) Inventors: Federico Catanese, Mendoza (AR); Esteban Rovello, Mendoza (AR)

( * ) Notice: Subject to any disclaimer, the term of this patent is extended or adjusted under 35 U.S.C. 154(b) by 0 days.

(21) Appl. No.: 17/308,470

(22) Filed: May 5, 2021

(65) Prior Publication Data

US 2021/0395991 A1 Dec. 23, 2021

(51) Int. Cl.
*E03D 13/00* (2006.01)

(52) U.S. Cl.
CPC ..... *E03D 13/005* (2013.01)

(58) Field of Classification Search
CPC ..... E03D 13/005
See application file for complete search history.

(56) References Cited

U.S. PATENT DOCUMENTS

| | | | | | |
|---|---|---|---|---|---|
| 4,383,421 | A * | 5/1983 | Quesnoit | F25D 11/025 | 62/333 |
| 5,305,473 | A | 4/1994 | Nakamura | | |
| 5,822,999 | A * | 10/1998 | Salo | F25B 41/20 | 62/215 |
| 2006/0201175 | A1* | 9/2006 | Shapiro | F25B 5/02 | 62/228.1 |
| 2009/0049844 | A1* | 2/2009 | Albayrak | D06F 58/206 | 62/3.3 |
| 2014/0097735 | A1* | 4/2014 | De Bona | F25D 23/063 | 312/406.1 |
| 2018/0163388 | A1* | 6/2018 | Staton | A61B 10/007 | |

FOREIGN PATENT DOCUMENTS

| | | | | |
|---|---|---|---|---|
| CN | 2865543 | | 2/2007 | |
| CN | 201416210 | | 3/2010 | |
| CN | 204804017 | | 11/2015 | |
| JP | 2002030716 | A * | 1/2002 | E03D 9/00 |
| KR | 100897534 | | 5/2009 | |
| KR | 20110002320 | U * | 3/2011 | E03D 13/005 |

* cited by examiner

*Primary Examiner* — Janie M Loeppke
(74) *Attorney, Agent, or Firm* — Defillo & Associates, Inc.; Evelyn A. Defillo

(57) ABSTRACT

A urinal module for installation in public toilets or private bathrooms, with the purpose of avoiding or reducing bad odors through the cooling of the contact surface of the urinal, where it impacts with the urine by the use of a cooling closed-circuit by direct expansion that includes a condensing unit and an electronic system of temperature control that are located in an external cabinet, separated from the urinal module. A centrally arranged water reservoir feeds the urinal module, each of which comprises a cooling streamer that leaves the condenser, enters through the back of the urinal closest to the cabinet and makes a journey through the inner back of the urinal to the point of contact with the lower reservoir of the same, resuming to the same point of entry of the urinal, from where it leaves, containing heated gas and returns to the compressor to achieve the closed-loop cooling effect. The temperature control of the urinal manages to form a thin ice protective layer, which will prevent the urine from vaporizing and, therefore, can be perceived by the sense of smell.

4 Claims, 5 Drawing Sheets

TEMPERATURE-CONTROLLED URINAL MODULE TO PREVENT ODORS

TECHNICAL FIELD

The present invention relates to urinal modules to be installed in bathrooms, whether public or private. In particular, to a urinal module with a built-in temperature control device to neutralize or eliminate bad odors.

BACKGROUND

Some urinal devices with anti-odor return are known in the state of the art. One of them is the utility model CN201416210 (Y) that proposes a male urinal mounted on the wall that comprises upper and lower water leakage molds and a floating ball, where the water leakage device fulfills the function of preventing the return of the odor by arranging the floating ball in the lower water leak mold, thus avoiding the possibility of self-emission of odors.

Another known Chinese utility model is the CN204804017 (U), which combats odors through an activated carbon fiber surface and an absorbent fiberglass inner lining in the internal insert of the urinal.

Other attempts to combat the bad smells in the previous art, is given by the realizations that propose to neutralize it through its direction. One of the antecedents of this group is U.S. Pat. No. 5,305,473, which provides an odor release port on a posterior surface of the urinal that has a duct connected to that odor release port. The urinal comprises a drainage trap provided at the bottom of it, where an air space communicates with a secondary side of the drainage trap, and a fan blows the air into the air space to the secondary side of the drainage trap.

Another solution in this sense, but without using water or electricity, is provided by the Korean publication KR100897534, which proposes a urinal with a deodorant port to which urine is induced through an entrance with an inclined disc that leads it to a discharge tube with odor trap, after passing through the aforementioned deodorant port.

Another similar variant is revealed by the Publication China CN2865543, which proposes an automatic closing urinal that is free of water and bad odors, comprising a urinal body, a rotating lid controller, an odor pumping mechanism, and an automatic urine discharge section. The rotating cover is placed over the opening of the urinal and the odor pumping mechanism comprises a ventilation connected to an exhaust pipe and an exhaust fan mounted on it, which is put into operation through a button-type ignition switch in the control box.

The problem with the aforementioned art is that all of them, beyond possible cumbersome and uneconomic realizations, propose palliative solutions to eradicate or minimize the perception of bad odors by the user once the gases coming from the urine have begun to vaporize and, therefore, to reach the sense of smell. But none of them try to avoid this step.

For this reason, it is the object of the present invention, to propose a urinal structure provided with the appropriate means to directly prevent the vaporization of the urine when making contact with the inner wall of the urinal, so that gases that can be perceived by the sense of smell are not generated.

Advantages—Differences with Previous Art

According to the above, the urinal module with a built-in temperature control device to neutralize or eliminate bad odors does not attack, nor perfume or lead to odor traps to the gases of the vaporized urine, but, on the contrary, prevents them from occurring through a simple temperature control system.

Taking into account that gases are less dense than liquids and solids and that they depend on the temperature and the state in which they are, two phenomena have been noticed, from which the invention has been developed:

1) vaporization, which occurs as the temperature rises, and 2) condensation, as the temperature decreases.

The present invention aims to achieve a balance that allows to eliminate the vaporization of the urine and the condensation of the water vapor contained in the ambient humidity, achieving these objectives through the control of the temperature of the proposed urinal module, considering the constant pressure.

The main advantages resulting from this invention are, on one hand, the elimination of odors without the use of any type of chemical products, some of them possibly derived from petroleum, such as detergents and/or naphthalene, commonly used to deodorize urinals or other sanitary appliances, keeping the environment free of odor; on the other hand, the present invention is intended for the generation of water obtained from the condensation of ambient moisture. This implies an ecological practice committed to the environment, since it implies savings in the consumption of water that is commonly used in the sanitary device, having to discharge less frequently, as well as a saving in the purchase of deodorizing products, with the consequent decrease in the frequency of cleaning that a sanitary requires for its disinfection and its respective environmental impact.

SUMMARY OF THE INVENTION

The proposed invention includes a urinal module for installation in public toilets or private bathrooms, with the purpose of avoiding or reducing bad odors through the cooling of the contact surface of the urinal where it impacts with the urine, by using a closed cooling circuit by direct expansion comprising a condensing unit and an electronic temperature control system that are located in an external cabinet separated from the urinal module.

A centrally arranged water reservoir feeds the urinal module, each of which comprises a cooling serpentine that exits the condenser, enters through the back of each urinal and travels through the inner part of the urinal to the point of contact with the lower reservoir of the same, returning to the same point of entry of the urinal. Once the serpentine leaves the urinal containing heated gas, it returns to the compressor to achieve the closed-circuit cooling effect. The temperature control of the urinals manages to form a thin protective ice layer, which will prevent the urine from vaporizing and, therefore, can be perceived by the sense of smell.

DETAILED DESCRIPTION OF THE INVENTION

Figure 1:
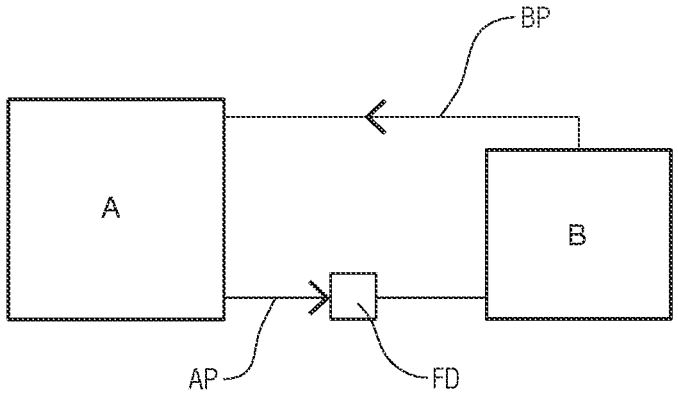
FIG. 1 shows a first schematic diagram, which illustrates in a general way how the concept of closed cooling circuit arranged in the urinal module with temperature control of the present invention.
Figure 2:
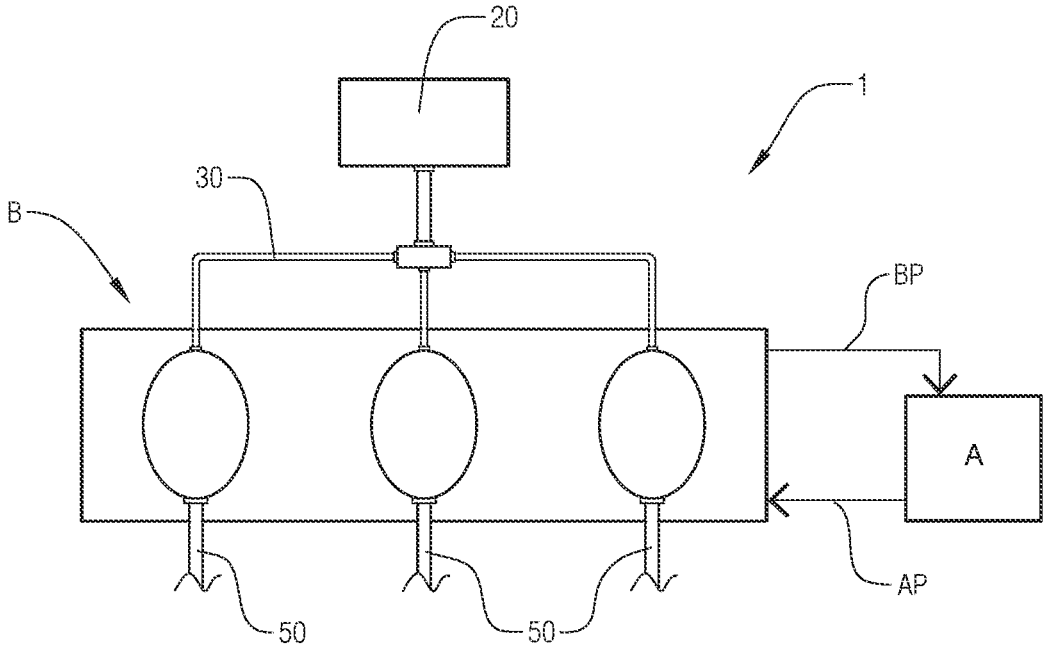
FIG. 2 shows another schematic diagram, which shows the general arrangement of the elements that make up the urinal module with temperature control of the present invention.

In a preferred example of realization, the urinal module (1) comprises two types of units connected to each other, the external condensing unit (A) and the evaporator unit (B), defining between them a low-pressure line (BP) and a high-pressure line (AP) that comprises a dehydrating filter (FD) between the unit (A) and the unit (B), as conceptually illustrated in FIG. 1.

The external condensing unit (A) comprises a compressor (8), a condenser (9), an electrical drive (10), and a temperature control system (11), which in turn comprises a thermistor t (12) and an electrical connection box (13).

The evaporator unit (B) comprises a housing (2) with three urinals (3) incorporated in the preferred embodiment, although in other embodiments the housing (2) can comprise two urinals or a single one. In all cases, the urinal (3) has a metallic surface, preferably stainless steel.

Figure 3:
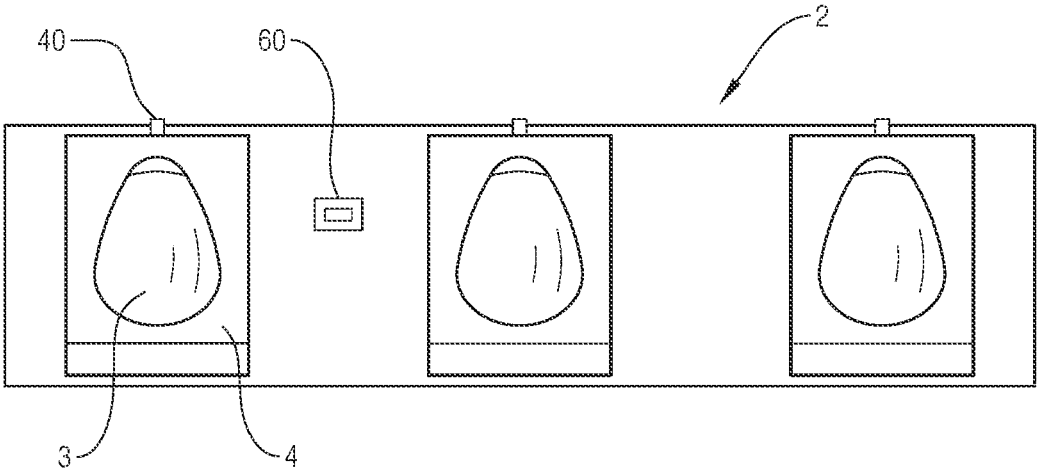
FIG. 3 shows a front elevation view of the temperature-controlled urinal module of the present invention.
Figure 4:
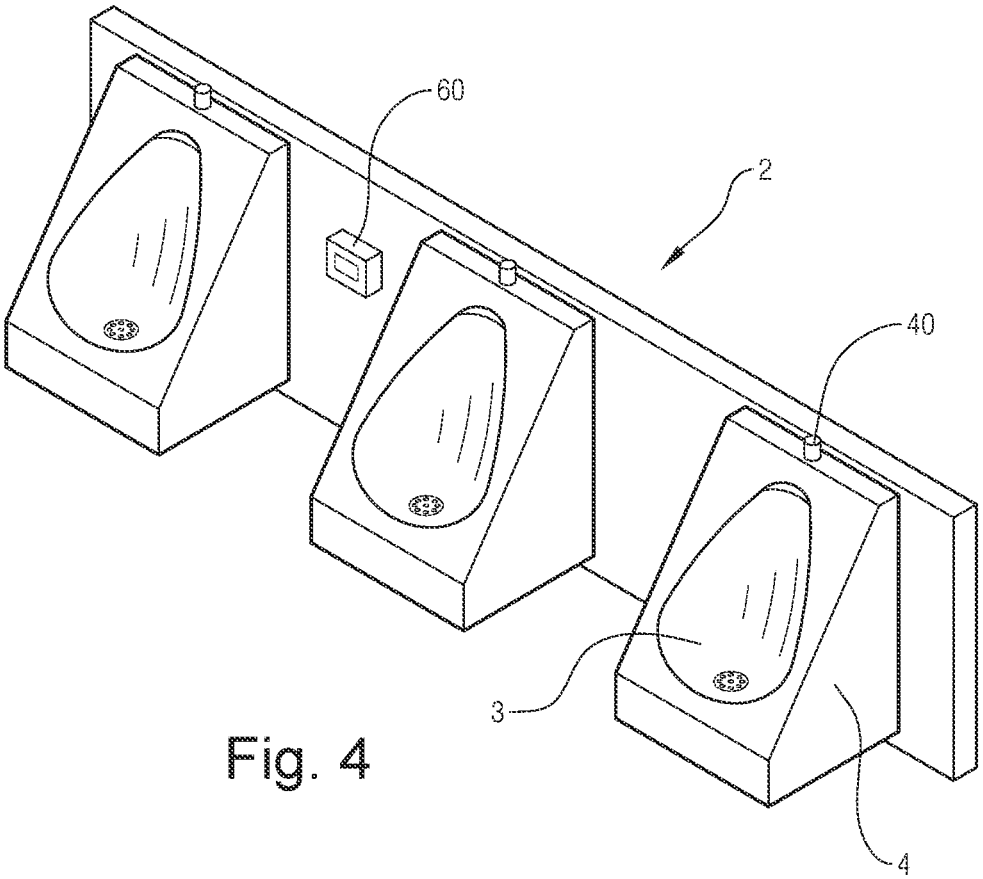
FIG. 4 shows a top front perspective view of the temperature-controlled urinal module of the present invention.

Each of the urinals (3) is projected out of the housing (2) and are contained within a hollow trapezoidal volume (4), as can be seen in FIGS. 3 and 4, of the preferred embodiment.

The set of three urinals (3) of the preferred embodiment arranged in the housing (2) comprise a conventional water supply and draining system, with an upper central tank or reservoir (20) that feeds each urinal (3) through the pipe (30) that connects with the upper reception pipe (40) arranged on the top of the housing (2). Similarly, each urinal (3) comprises a conventional drain pipe (50) to be connected to the drainage network of the bathroom in which the proposed urinal module is installed (1).

Figure 5:
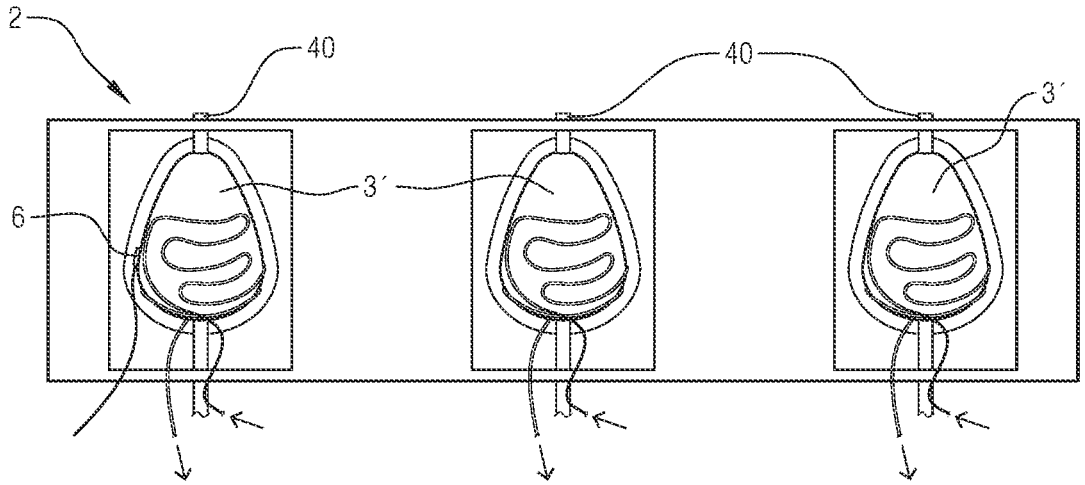
FIG. 5 shows a rear view of the urinal module with control of temperature of the present invention.
Figure 6:
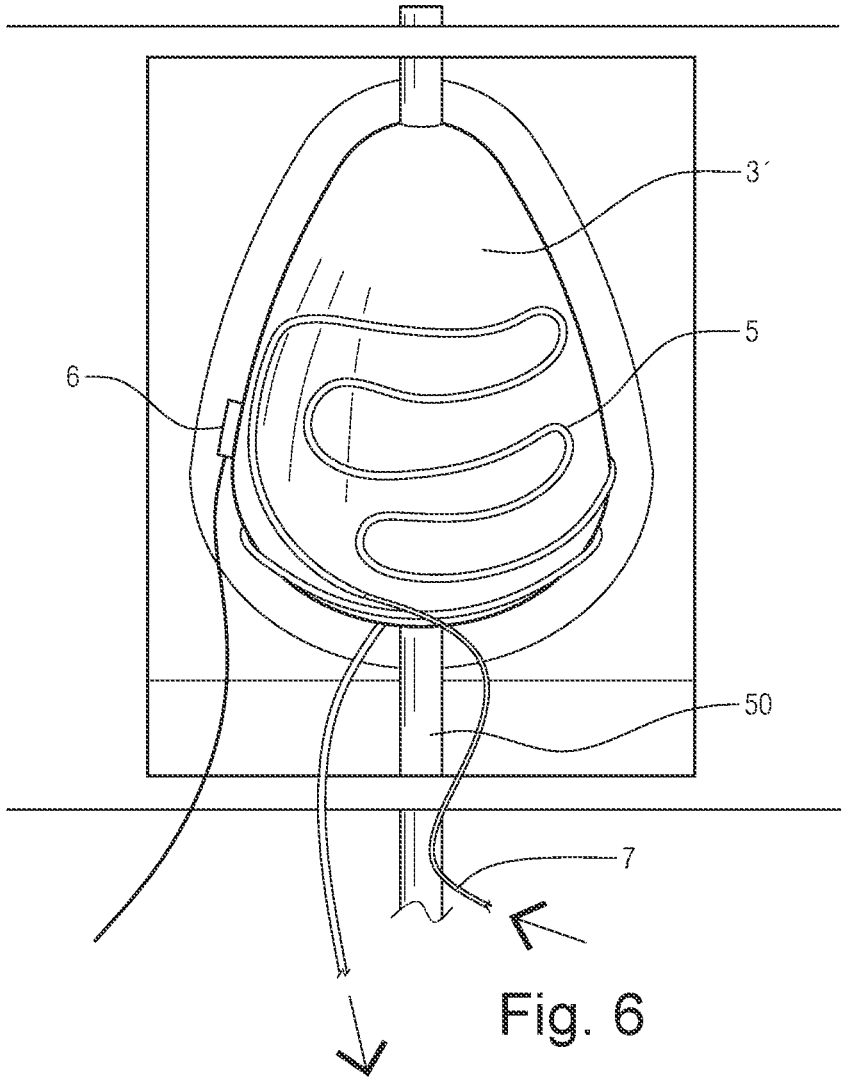
FIG. 6 shows a rear detailed view of only one of the urinals with temperature control of the present invention, showing in detail the path of the serpentine.

Each urinal (3) comprises, in its rear part (3'), a copper cooling serpentine (5), welded with tin, which completely surrounds said rear part (3'), as shown in FIGS. 5 and 6. The serpentine (5) is the continuation of a capillary tube (7) of 1 mm that serves as a restrictor, producing the change of state from liquid to gas, that is, of the liquid that comes from the condenser (9).

The first of the urinals (3) also comprises a temperature sensor probe (6) of the NTC thermistor type, as can be seen in the detail of FIG. 6.

Both the serpentine (5) and the capillary (7) of each urinal, as well as the sensor probe (6) of the first urinal, attached to the posterior curved face (3') of the same, are covered by an insulating aerosol of expanded polyurethane (not represented), which is used to cover in an insulating way the steel bottom of the curved rear part (3') of each urinal (3), in order to avoid a loss of temperature (cold applied to the urinal).

In the cooling serpentine (5) circulates liquid in an evaporation stage at constant pressure, handled by the compressor (8) that aspirates evaporation gases and also compresses them at constant pressure to the condenser (9), which transfers the heat to the medium, achieving that it becomes liquid and then expands in the serpentine (5) at constant pressure and temperature, thus managing to remove the heat from the urinals (3), continuously repeating the refrigeration cycle over time. The equipment, the compressor (8) and the condenser (9), are all part of the condensing unit (A) that is external to the urinal module, which is installed in the bathroom, next to them.

This external condensing unit (A) also comprises an electrical drive system (10) that provides electrical power to the entire module (1) and a temperature control system (11), as detailed below. In turn, each urinal is considered an evaporator unit (B), each with its own capillaries, and the evaporation system connected in parallel.

The aforementioned sensor probe (6) incorporated in the rear of the first urinal (3) senses the temperature of the same by an electronic thermistor (12), which is part of the integral temperature control system (11) that is directed from the external unit (A) and that has the possibility to program and thus vary those starting points of the cooling system and final of the same, depending on the temperature and ambient humidity variables that arise from the site where the proposed urinal module (1) will be installed, as will be explained later.

A display (60) placed on the front of the housing (2) connected to the sensor probe (6) and the integral temperature control system (11) of the external unit (A), shows the sub-zero temperature maintained on the inner surface of the urinal, thanks to the work of the cooling serpentine (5) and the expanded polyurethane insulation placed on the steel bottom of the curved rear face (3') of the urinal.

The objectives sought are achieved by cooling the urine and condensing the ambient humidity through the proposed device, so that the urinals remain at temperatures in a range of −3° C. to 3° C.; this range will depend on the temperature and ambient humidity of the country or province corresponding to the place where the sanitary device is installed.

For example, we know that freezing happens at sea level at zero degrees Celsius and increases as the height increases. For this reason, freezing occurs to a greater or lesser extent according to the relative humidity and evaporation temperature of the serpentine of the urinal.

Taking into account that the average temperature of the urine is estimated at 34° C., you can set the vaporization temperature of the same, which is what is intended to avoid. The vapors of the urine reach the smell senses if the surface temperature exceeds 3° C., so that is the temperature limit that the urinal must not exceed, in order to avoid the vaporization of the urine. Based on this, the type of restrictor to be used can be designed, so that the temperature is maintained in the desired range plus 1° C. or minus 1° C.

The restrictor will also be evaluated according to the amount of liquid needed to cope with the thermal load associated with these evaporation surfaces and according to the evaporation temperature and the average relative humidity of the site. For the preferred embodiment of the present, the capillary (7) of 1 mm of section is the appropriate restrictor.

The urine temperature is not the only value that has had to be taken into account to arrive at the claimed solution. The exposed surface of the urinal should also be considered according to the thermal load associated with the ambient temperature, the average discharge of the urine, the eventual discharge of water for automatic cleaning and the average relative humidity of the place.

The formula for obtaining the value C would be as follows:

$$C=c\times M\times(Ta-Te)$$

Wherein:

C=is the amount of heat Kcal/h,

M=is the total mass to be cooled equivalent to the sum of the drainage water, moisture water, and others, c=is the specific heat of air and water, taking as an average the value of 1, Ta=ambient temperature of air and orin, considered at 30° C., and Te=evaporator temperature, considered at 3° C.

Wherein the C value measured in unit of kcal/h, would be: C=1×20×27=540 Kcal/h. Kcal is kilocal/hour=unit of thermal energy.

Based on the value obtained, it is possible to choose the type of condensing unit needed to obtain the desired results. In this case, it will be enough with a condensing unit of 1 Hp, for example, of the type of those currently marketed by the firm Good Cool.

Figure 8:
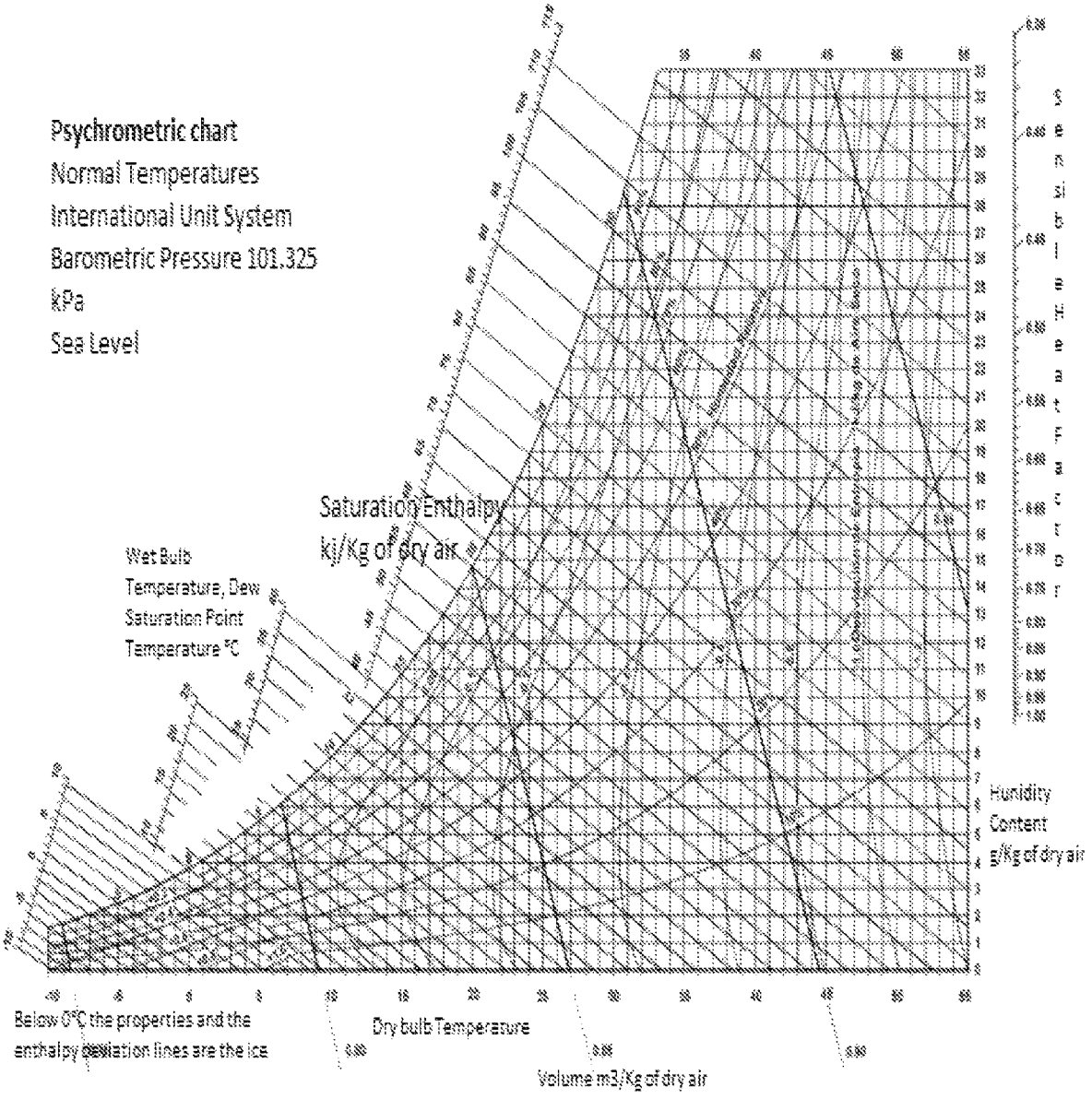
FIG. 8 shows a psychrometric chart.

To determine the above, it was necessary to make thermodynamic tests using psychrometric charts as shown by FIG. 8.

The thermodynamic state of atmospheric air at a certain pressure already established is measured by means of two independent intensive properties, such as temperature and humidity, elements necessary to have a basic knowledge of the properties of air and humidity.

Psychrometric charts (FIG. 8) are used to study how properties vary with the changing humidity in the air.

A psychrometric chart is a graph of the air properties, such as temperature, enthalpy, volume, pressure, etc., plotted with values proposed in the psychrometric table, therefore, the psychrometric chart can be based on data collected at atmospheric pressure at sea level, and similarly for pressures slightly less than or greater than the pressure at sea level.

In a psychrometric chart are all the properties of air, as at the beginning it was said, it is necessary to obtain two intensive properties and, in this way, you can enter the table, the following being the most important:

Dry Bulb Temperature
Wet Bulb Temperature
Dew Point Temperature
Relative Humidity
Absolute Humidity
Enthalpy
Specific Volume The preferred embodiment determines a freezing temperature of −3° C., however, as stated above, this value may vary depending on the temperature and ambient humidity of the country or province corresponding to the location where the claimed urinal module is installed.

According to the psychrometric chart of FIG. 8, in the preferred embodiment, it can be seen that the absolute humidity associated with a temperature of 28° C. and a relative humidity of 35% at sea level, is 11 grams per kg of dry air, therefore, a small value but sufficient to form a small ice protective layer.

As it emerges from the chart of table 1, the dew point is approximately 12° C., so taking the temperature of the urinal to −3° C. a solidified surface is obtained, thus achieving the pre-established objective of eliminating or at least minimizing the effects of bad odors, by avoiding the possibility that the gases of the urine vaporize and reach the smell when it comes into contact with the surface of the urinal.

Thus, when a user makes use of the present urinal module, the urine expelled at an average temperature of 34° C. will not contact directly with the inner front surface of the urinal (3), but with the thin protective ice layer that it has formed, thanks to the frozen condensation water at −3° C., which will melt in the impact zone and cause a "sweeping" effect that will prevent odors from being produced by the effect of vaporization and are perceived by the sense of smell.

In the best case, the user will discharge the relevant water through the tank (20) intended for this purpose and will take any trace of urine that may have remained in the urinal, preventing the odors return, since there will be no direct contact with the inner wall of the urinal. In case the user does not perform the corresponding water discharge, the solidification phenomenon of the condensation water by temperature difference will occur again in a period of between 3 and 5 minutes, thus completing the cycle for a new use.

Figure 7:
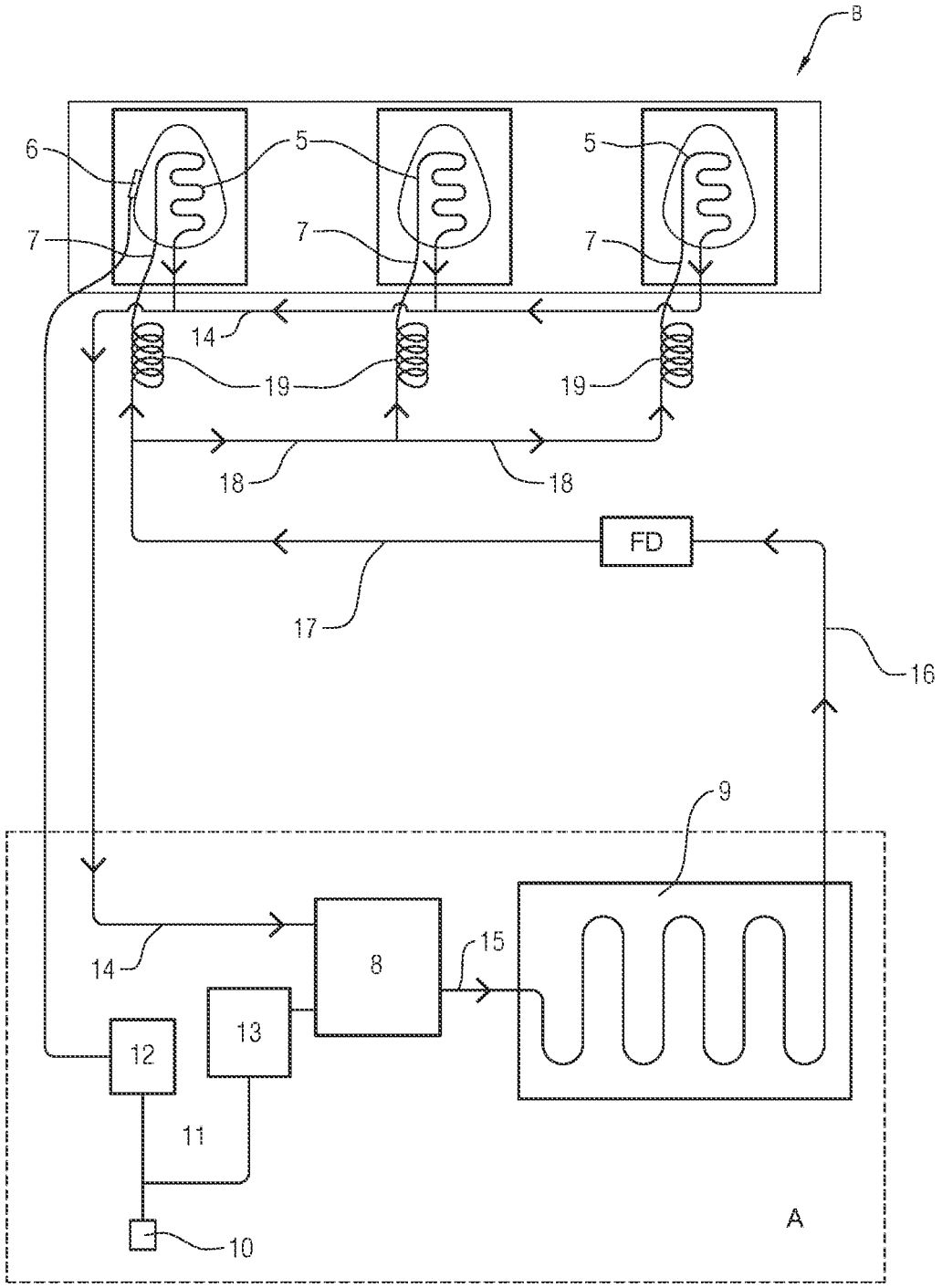
FIG. 7 shows a schematic diagram that shows in FIG. 1, representing each and every one of the elements that make up the urinal module with temperature control of the present invention and how they are connected to each other.

According to the preferred embodiment of the present invention, as can be seen in the diagram of FIG. 7, the compressor (8), for example a 1 Hp motor compressor, is the one that initiates the cooling circuit by sucking the gas at low pressure that arrives from the urinal by a copper pipe (14), preferably ¼", compressing said gas at constant pressure and then discharging hot gas to the condenser (9) through a copper pipe (15), preferably 3/16" in diameter.

The condenser (9), forced by a 30 cm diameter forcer preferably, transfers heat to the medium and manages to transform the gas to a liquid state, cooling it at constant pressure, which circulates through a copper pipe (16) until it passes through the dehydrating filter (FD), which removes moisture and other contaminants that the liquid may have. A refrigerant of the ecological type R410A is used, preferably.

The refrigerated liquid continues its journey from the filter (FD) through a copper pipe (17) preferably of 3/16" in diameter, until, in proximity to the urinal or evaporator unit (B), the aforementioned pipe 17 is divided into three sections defining a system in parallel, at the request of the derivations (18), which at its ends are welded to the capillaries (19) of 1 mm and 4.9 m in length, preferably.

The capillary (19) acts as an expansion device, as the liquid suffers a great loss of load due to its small diameter of 1 mm, so that the coolant loses most of the pressure with which it came from the compressor (8) and the condenser (9), depending on the length of 4.9 m of it, pressure that kept its volume reduced. When losing pressure, the liquid expands in the capillary (19) and arrives in that state at the final section (7) of the capillary, contacting the rear part (3') of the urinal through the serpentine (5), which runs through and wraps the entire rear part (3) of the urinal, thus converting the liquid into gas, by absorbing the heat of the serpentine (5).

Said copper serpentine (5) preferably has a diameter of 3/16" and is welded to the rear part (3') of the urinal by tin welding; while the weld between the final section (7) of the capillary and the serpentine (5) is silver.

On the other hand, and always according to the preferred embodiment of FIG. 7, it can be observed that one of the urinals of the module (1) comprises in its rear parts (3') a probe (6) of the NTC thermistor type. This probe (6) is a temperature sensor connected by a cable to the thermistor (12) that integrates the temperature control system (11). This probe (6) measures the temperature of the urinals, reflects it in the display (60) mounted on the housing (2) and sends such information to the temperature control system (11) to regulate it, depending on the desired values, which have been previously configured. This regulation, based on the information sent by the probe (6) allows, for example, to stop or start the compressor (8) and in this way, stop or start the cooling process depending on the pre-established needs.

What is described above includes a preferred embodiment. As such, it is obviously not possible to describe every conceivable combination of the components or methodologies employed for the purpose of describing such a realization, but a person with experience in the technique may recognize that many other combinations and changes are possible. In conformity, this preferred mode is intended to cover all such alterations, modifications and variations that are contained by the scope of the claims below.

The invention claimed is:

1. A urinal module having a temperature control (1) to avoid bad odors, comprising:

an external condensing unit (A);

an evaporator unit (B) connected to the external condensing unit;

a low-pressure line (BP) between the external condensing unit and the evaporator unit;

a high-pressure line (AP) between the external condensing unit and the evaporator unit;

a dehydrating filter (FD) directly connected on a first side to the external condensing unit (A) and directly connected on a second side to the evaporator unit (B);

wherein the external condensing unit (A) comprises:

a compressor (8) connected to a condenser (9), an electrical drive (10) connected to the compressor and the condenser; and a temperature control system (11) configured to feel the temperature of the evaporator unit (B), wherein said evaporator unit (B) comprises:

a housing (2) having at least two metallic urinals (3) placed next to each other, each one of the at least two metallic urinals project out of the housing (2), wherein the condensing unit and the evaporator unit being able to form a thin ice layer on an inner front face of the at least two metallic urinals (3) while maintaining the temperature in a range of 3° C. to −3° C., wherein each one of the at least two metallic urinals (3) have a cooling serpentine (5) that exits the condenser, enters through a back of each urinal, and travels through an inner part of each urinal to a point of contact with a lower reservoir of the urinal;

wherein a temperature probe (6) is located on the back of the urinal near the condenser unit (A), the temperature probe is connected by a cable to a thermistor (12) that integrates a temperature control system (11) located in the external condensing unit (A), reflecting the temperature measured in a display (60) mounted on the front of the housing (2) and sending such information to said temperature control system (11);

wherein a capillary tube (19) has a first end (7) fixed to the cooling serpentine and a second end connected to the dehydrating filter (FD);

wherein the cooling serpentine (5), the temperature probe (6), and the first end (7) of the capillary tube (19) are covered with an insulating layer;

wherein said low pressure line (BP) starts at an exit of the at the least two metallic urinals (3) through a pipe (14) that transports gas at low pressure, the gas is sucked by the compressor (8) that starts said high pressure line (AP) by compressing said gas at constant pressure and then discharging a hot gas to the condenser (9) through a pipe (15), wherein said condenser (9) transfers heat to a medium and transforms the gas to a liquid state, cooling the medium to constant pressure, which circulates through a second pipe (16, 17) having an end-welded to the capillary tube (19) to expand the liquid to cool the at least two metallic urinals (3), absorbing heat and converting the liquid into gas, which leaves the at least two metallic urinals (3), thus closing the high pressure line (AP) and starting the cooling cycle again at the start of the low pressure line (BP).

2. The urinal module according to claim 1, wherein each one of the at least two metallic urinals further comprises a rear curved part, and wherein the rear curved parts (3') are covered by an expanded polyurethane insulating layer.

3. The urinal module according to claim 1, wherein each one of the at least two metallic urinals (3) comprises a feeding system and a water draining system with a central upper tank or reservoir (20) that feeds said the at least two metallic urinals (3) through a pipe (30) that connects with a pipe of upper reception (40) arranged on the top of the housing (2);

wherein said at least two metallic urinals (3) further comprises a drain pipe (50) adapted to be connected to a drainage network of a bathroom in which the urinal module (1) is installed.

4. The urinal module according to claim 1, wherein the external condensing unit (A) comprises an electrical junction box (13) connected to the compressor (8) and the electric drive (10) provides electrical energy to the urinal module (1).

* * * * *